US005520521A

United States Patent [19]

Benckert et al.

[11] Patent Number: 5,520,521

[45] Date of Patent: May 28, 1996

[54] HYDRAULIC CONTROL DEVICE FOR A VISCOUS FLUID PUMP

[75] Inventors: Hartmut Benckert, Filderstadt-Sielmingen; Hans Renz, Filderstadt; Werner Muenzenmaier, Nuertingen, all of Germany

[73] Assignee: Putzmeister-Werk Maschinenfabrik GmbH, Aichtal, Germany

[21] Appl. No.: 196,170

[22] PCT Filed: Jun. 5, 1992

[86] PCT No.: PCT/EP92/01259

§ 371 Date: Feb. 15, 1994

§ 102(e) Date: Feb. 15, 1994

[87] PCT Pub. No.: WO93/04282

PCT Pub. Date: Mar. 4, 1993

[30] Foreign Application Priority Data

Aug. 17, 1991 [DE] Germany ..... 41 27 277.3

[51] Int. Cl.[6] ..... F04B 15/02; F04B 49/03

[52] U.S. Cl. ..... 417/280; 417/46; 417/297; 417/403; 417/509; 417/900

[58] Field of Search ..... 417/46, 280, 297, 417/403, 507, 509, 900

[56] References Cited

U.S. PATENT DOCUMENTS 3,205,906 9/1965 Wilkinson et al. ..... 417/507
3,494,290 2/1970 Schaible .
5,222,872 6/1993 Marian et al. ..... 417/900
5,316,453 5/1994 Schwing ..... 417/900

FOREIGN PATENT DOCUMENTS 0283832 9/1988 European Pat. Off. .
3833845 4/1990 Germany .

*Primary Examiner*—Richard A. Bertsch
*Assistant Examiner*—William Wicker
*Attorney, Agent, or Firm*—Flynn, Thiel, Boutell & Tanis

[57] ABSTRACT

In a hydraulic control device for a viscous fluid pump with at least one feed cylinder (11) drivable by a hydraulic cylinder (12), the feed chamber (17) of which can be alternately connected via a hydraulically operable inlet valve (18) a hydraulically operable outlet valve (21) to a reservoir (19) and a feed line (22), whereby in the loading phase of the feed cylinder (11) the inlet valve (18) is open and the outlet valve (21) closed and in the feed phase of the feed cylinder, in which its piston is driven so as to reduce the volume in the feed chamber (17), the outlet valve is open and the inlet valve is closed, and with a hydraulic sequence control actuating the correct cyclic changeover between the inlet and outlet valves and the changeover of the pump drive, a valve forming part of the changeover control device of the sequence control and relieving the pressure in the feed chamber of the control cylinder (53) designed to actuate the outlet valve (21) takes the form of an electrically or hydraulically actuated valve (71) controlled dependently upon the high pressure in the drive cylinder (12) of the feed cylinder (11). Said valve (71) is switched to its through-flow setting on reaching an adjustable and predeterminable minimum of the pressure in the drive cylinder (12).

15 Claims, 5 Drawing Sheets

HYDRAULIC CONTROL DEVICE FOR A VISCOUS FLUID PUMP

FIELD OF THE INVENTION

The invention relates to a hydraulic control device for a viscous fluid pump that includes at least one feed cylinder drivable by means of a hydraulic cylinder.

BACKGROUND OF THE INVENTION

Hydraulic control devices such as are known from German Patent Document DE 38 33 845 A1 are used to control two-cylinder viscous fluid pumps. The feed cylinders of these pumps are each driven by a hydraulic linear cylinder, work in a push-pull operation. In other words, one cylinder feeds, while the other—in the so-called suction stroke—is loaded with material to be transported, for example with concrete. The alternating opening of the feed chambers of the two feed cylinders toward the storage container containing the material to be transported and the alternating connecting of the feed chambers to a feed line is done by a tube switch. This switch controls both the function of an inlet valve for the feed cylinders which, through a changeover of the tube switch, moves into a communicating connection with the storage container, and also the function of an outlet valve for the feed cylinder carrying out the feeding stroke, the feed chamber of which feed cylinder being connected to the extended feed line. To changeover the tube switch to the two alternative feed paths, hydraulic linear cylinders acting in opposite directions are provided. The pistons of these cylinders are kinematically positively coupled with one another through the tube switch and can be reversed through an alternating pressure loading and pressure relief of the bottom-side control chambers of the two linear cylinders.

The feed line, which can be connected alternatingly to the feed chambers of the feed cylinder through the tube switch, can be blocked from the tube switch by means of a shutoff device controlling the function of the outlet valve. This shutoff device is a seated valve which can be moved into its blocking position by a bottom-side pressure loading of a hydraulic control cylinder, in which blocking position the feed line is blocked off from the tube switch. After the pressure relief of the bottom-side control chamber toward the tank of the pressure-supply plant, this valve is moved into its open position connecting the tube switch to the feed line by the pressure developing during the feeding operation in the respective feed cylinder in its feed chamber. To control the feeding operation of the viscous fluid pump, a sequence control is provided which reacts to hydraulic or electrical outlet signals from the end-position indicators which monitor the positions of the drive cylinders of the feed cylinders, the control cylinders for the tube switch and the control cylinder of the shutoff device. This sequence control ensures that the feed cylinders are actuated to carry out the feeding or loading stroke until after the tube switch has been moved into the operating position suited for the feeding and loading operation of the feed cylinders. The flow path, through which the pressure loading of the control cylinder in the sense of a closing movement of the shutoff device occurs, leads through a check valve, which is loaded in an opening direction by the high control pressure. The relief path, through which pressure medium can discharge from the bottom-side drive chamber of the control cylinder, is guided through a pressure-limiting valve which is connected in parallel to the check valve. This pressure-limiting valve is set in its open position as soon as the pressure—during the feeding operation—exceeds an adjustable presettable value. This is supposed to occur so that the shutoff device opens only when the pressure in the feed chamber of the respective feed cylinder operating in the feeding operation corresponds approximately to the pressure existing in the feed line in order to achieve a desired pre-compression of the material being transported in the feed chamber and to avoid uneven operation of the pump caused by the pressure differences between the feed chamber and the feed line.

This type of changeover of the shutoff device prevents the pressure in the bottom-side drive chamber from dropping below the pressure threshold specified by the setting of the pressure-limiting valve. This may not be advantageous as long as during the course of the pump operation the friction ratios do not change and the pre-compression pressure is sufficient to open the shutoff device against the pressure present at the shutoff device, which hereby, however, will not reach a definite opening position but a position of a dynamic pressure balance, that is, it will stop in a position between its closing position and the position of a maximum opening cross section. This position will be, in particular with the common arrangement of the feed line such that it branches laterally off from the valve chamber through which the piston rod of the control cylinder, which piston rod has the valve member, axially passes, a position in which the valve member is in the area of the port opening, which from a technical flow standpoint is much less favorable than when the piston can be moved on into an end position, in which the port opening of the feed line is completely open. A disadvantageous result of this is that a significant greater amount of driving energy is needed for the drive cylinder of the feed cylinder; in addition, the position, in which the control piston of the shutoff device reaches its balancing position, can also depend on the friction ratios in the drive system, with which a clear correction between the necessary pre-compression pressure and the pressure which is indeed needed to open the shutoff device, does not exist so that in particular when the friction ratios change during the course of a longer operation, an increasingly uneven run of the pump occurs. This can indeed be countered by reducing the reaction threshold value of the pressure-limiting valve which, however, is complicated.

If, on the other hand, an "active" opening of the shutoff device is achieved, for example, by loading the rod-side drive chamber of its control cylinder with pressure for opening the shutoff device, then a correlation between the pre-compression pressure and the opening pressure of the shutoff device does no longer exist, and it is at least difficult to achieve an adjustment of the pump and its control valves so that the shutoff device opens at least approximately at the pressure existing in the feed line, which is the important condition for being able to avoid compression strokes or decompression strokes during the changeover of the cylinders from the feeding to the loading operation. In addition, such an active opening of the shutoff device requires a significant amount of technical hydraulic switching and additional expense.

SUMMARY OF THE INVENTION

The purpose of the invention is, therefore, to improve a hydraulic control device of the above-mentioned type for a viscous fluid pump so that significantly vibration-free operation of the pump can be achieved.

This purpose is achieved according to the invention in such a manner that the valve of the changeover control device, which controls the pressure relief of the driving pressure chamber of the control cylinder provided for operating the outlet valve, is designed as an electrically or hydraulically operable valve. The valve state is a function of the high pressure produced for the pressure loading of the drive cylinder of the feed cylinder. The valve, upon reaching an adjustably preset minimum value of the pressure coupled into the drive cylinder, is switched into its through-flow position, in which pressure medium can discharge from the driving chamber of the control cylinder.

With this type of changeover of the outlet valve, frictional effects, which could influence the opening of the valve are, so to speak, eliminated, and it is achieved in a simple manner that the outlet valve opens at a pressure in the feed chamber of the feed cylinder, which pressure corresponds in a very good proximity with the pressure existing in the feed line which, at an optimum, corresponds with the quiet operation of the pump, with a one-time adjustment of the minimum value of the pressure at the start of the operation being sufficient to achieve, with a specified composition of the material to be transported, the mentioned favorable operating conditions during the operation.

With the alternative designs of the pressure-relief valve, one as a through-flow valve which, when it opens, transfers immediately into its position with the greatest through-flow cross section, or as a proportional valve which with an increasing control pressure releases an increasingly greater opening cross section, with a check valve each being connected in parallel to one such valve, which check valve is loaded by higher pressure at its connection remote from the changeover cylinder than in the driving pressure chamber of the control cylinder in opening direction and through relatively higher pressure in the driving pressure chamber in blocking direction, various changeover characteristics can be achieved which, depending on the purpose of the pump, can be utilized in the sense of a quiet run of the pump.

In place of such a pressure-controlled through-flow valve with a check valve connected in parallel thereto, it is also possible according to a preferred development of the control device of the invention to provide a remote-controlled check valve controlling the functions of both the through-flow valve and also the check valve, which remote-controlled check valve is blocked in blocking direction by a relatively higher pressure in the driving pressure chamber of the control cylinder and reaches its open position corresponding with the maximum opening cross section through remote control by means of the pressure coupled into the drive cylinder of the feed cylinder.

When the drive cylinder of the feed cylinder has a first end-position indicator which emits an end-position signal impulse when the piston of the drive cylinder—in the end phase of the feeding stroke of the feed cylinder—reaches the direct vicinity of its end position in this respect, and has a second end-position indicator which emits an end-position signal impulse when the piston of the drive cylinder—in the end phase of the loading stroke of the feed cylinder—reaches the direct vicinity of its end position in this respect and an operating control valve can be switched with the end-position signal impulses of the end-position indicators, through which control valve occurs each in a push-pull operation the pressure loading and relief of inlet chambers of hydraulic cylinders associated with the inlet and the outlet valves as operating elements in such a manner that the inlet valve closes at each one of the two feed cylinders when the outlet valve opens and the closing and opening movements of its inlet and outlet valve take place in a reverse sequence at the respective other feed cylinder, and when at least one end-position indicator is provided, which produces an outlet impulse when the inlet valve reaches its blocking position and a further end-position indicator, which produces an outlet signal correlated to the widest possible open position of the inlet valve, and the outlet signals of these end-position indicators associated with the valve positions control the changeover of a main slide valve, which controls the feeding and loading phases of the feed cylinder. A further preferred development of the control device provides that the further end-position indicator provided for detecting a valve position is associated with the outlet valve and produces its outlet signal when the piston of the hydraulic cylinder, provided for the closing and opening control of the outlet valve, reaches its end position connected with the blocking state of the outlet valve. Thus a reliable sequence control of the viscous fluid pump is possible in this manner by means of the end-position indicators which can be realized as a purely hydraulic control when hydraulic impulse transmitters are utilized as the end-position indicators and the valves controlled by these are designed as pressure-controlled valves, or as an electric sequence control when the end-position indicators are designed as electrical or electronic position sensors and the valves controllable by these are designed as magnetic valves.

The hydraulic control device is also suited for a viscous fluid pump designed as a two-cylinder pump with feed cylinders, which can be driven in a push-pull operation controlled by a changeover of the main slide valve, and the feed chambers of which feed cylinders can be connected in a corresponding push-pull operation through an inlet valve to the storage container and an outlet valve to a common feed line, with the push-pull operation of the inlet and of the outlet valves, which push-pull operation is also controlled through the sequence control with the push-pull control of the drive cylinders, being done by means of hydraulic differential cylinders as changeover cylinders, through the alternative bottom- or rod-side pressure loading of which these valves can be controlled into their closing or into their open positions, and with the related pressure loading of these changeover cylinders occurring through two control lines connected to an operating control valve, which control lines are connected in virtually "complementary" switch connections to the bottom-side control chamber of each one of the control cylinders of the inlet valves and the rod-side control chamber of the respective other one of the inlet valves.

A technically simple realization of the control of the operating sequences is possible in such a viscous fluid pump in such a manner that outlet signals needed for the reversal of the operating control valve are emitted by end-position impulse transmitters which are associated with one of the drive cylinders provided for a feed cylinder, and emit a signal when the piston of this drive cylinder reaches its end position connected to the end phase of the feeding stroke or the end phase of the loading stroke, and control signals needed for the changeover control of the main slide valve, through which occurs the drive control of the drive cylinders of the two feed cylinders, which drive control takes place in the sense of the push-pull operation, are produced by end-position indicators which are associated with the hydraulic cylinders provided for the changeover of the inlet valves and emit an end-position impulse always when the pistons of these hydraulic cylinders each reach the end position connected with the closed position of the respective valve.

A changeover device advantageously provided for the two-cylinder viscous fluid pump, by means of which the pump can be switched to return operation, during which viscous fluid is pumped from the feed line back into the storage container, can be realized in a simple manner such that changeover control devices of the outlet valves are each connected between the control chambers of the changeover cylinder of the outlet valve, through the pressure loading of which this valve is switched into the closing position, and the one of the two control lines, through the pressure loading of which the inlet valve belonging to the same feed cylinder can be controlled into its open position, and that for the two changeover cylinders of the outlet valves there is provided an operational changeover valve which, in a spring-centered base position associated with the normal feeding operation, connect the rod-side control chambers of the changeover cylinders of the outlet valves to the tank of the pressure-supply plant, and in its through-flow position alternative thereto connects the rod-side control chambers of the changeover cylinders of the outlet valves each to those of the two control lines through which the inlet valve of the feed cylinder is controlled into its blocking position.

In order to assure also at comparatively low feed pressures that a cycle-correct changeover of a main slide valve can occur, through which the alternating pressure loading and relief of the two drive cylinders of the viscous fluid pump occurs, end-position impulse signals utilized for its control and released with the closing of the inlet valves, with which end-position impulse signals the changeover parts of the main slide valve can be operated, are fed thereto through time-delay elements.

When this main slide valve is designed as a pressure-controlled valve which can be switched between its alternative operating position by alternatively loading two control chambers with pressure, such time-delay elements can be designed as simple throttle points which are arranged in the impulse-signal paths leading from the impulse transmitters to the control chambers of the main slide valve. It can thereby be sufficient when the mentioned time delay is active only during the return operation of the viscous fluid pump and thus the throttle points are arranged in the through-flow paths of an operational changeover valve, through which during the return operation the end-position pressure impulses are fed to the control chambers of the main slide valve.

It is advantageous in every case when alternatively or in addition to such throttle points of an operational changeover valve there are provided throttle points of the impulse-signal path which are formed by adjustable throttles in order to adjust their flow resistances in view of a reliable changeover of the main slide valve.

In a two-cylinder viscous fluid pump, in which for connecting the respective feeding cylinder to a common feed line and connecting the other cylinder to the storage container of the pump, there is provided a S-tube switch, the outlet side of which can be blocked against the feed line during the changeover of the drive cylinder and of the switch itself by means of a shutoff device, for the drive of which a differential cylinder is provided, through the bottom-side pressure loading of which the shutoff device which is arranged at the end of the piston rod of the differential cylinder, which end is remote from the piston, can be moved into its closing position. A particularly simple realization of the hydraulic sequence control provided for the operationally correct control of the drive cylinder of the pump and of the inlet valves and of the shutoff device is possible in such a manner that a valve combination including a closing control valve and an opening control valve in a hydraulic series connection, which valve combination has a first outlet which is connected to the control inlet of the changeover control device, through which the pressure loading of the bottom-side control chamber of the differential cylinder for closing the shutoff device and the pressure relief of this control chamber for opening the shutoff device is done, and a second outlet, which can be connected to the rod-side control chamber of the changeover cylinder of the shutoff device through an operational changeover valve associated with the shutoff device, with the pressures at the two outlets of the valve combination being able to be reversed by individually switching each one of the two closing and opening control valves.

By means of a second operational changeover valve associated with the shutoff device, in the operating position of which, which operating position is associated with the return operation, the high control pressure is present at the other operational changeover valve of the shutoff device, there is also created a bypass to the inlet and the outlet control valve of the shutoff device, through which the differential cylinder is permanently held during the return operation of the pump in the pressure-loading state corresponding with the open position of the shutoff device.

By means of an end-position indicator, which produces an output signal characteristic for reaching the closing position of the shutoff device, with which outlet signal a control-pressure supply control valve can be controlled, through which the control pressure can be fed to the changeover cylinders of the tube switch, it is guaranteed in a simple manner that the changeover of the tube switch and of the drive cylinder occurs only after the shutoff device has closed. If the pump of the pressure-supply plant is designed as a load-sensing control pump, it is also possible to control with the output signal of the end-position indicator of the shutoff device an operating phase of the pump to achieve a maximum feed performance.

BRIEF DESCRIPTION OF THE DRAWINGS

Further details and characteristics of the invention result from the following description of specific embodiments in connection with the drawings, in which.

DETAILED DESCRIPTION

Figure 1:
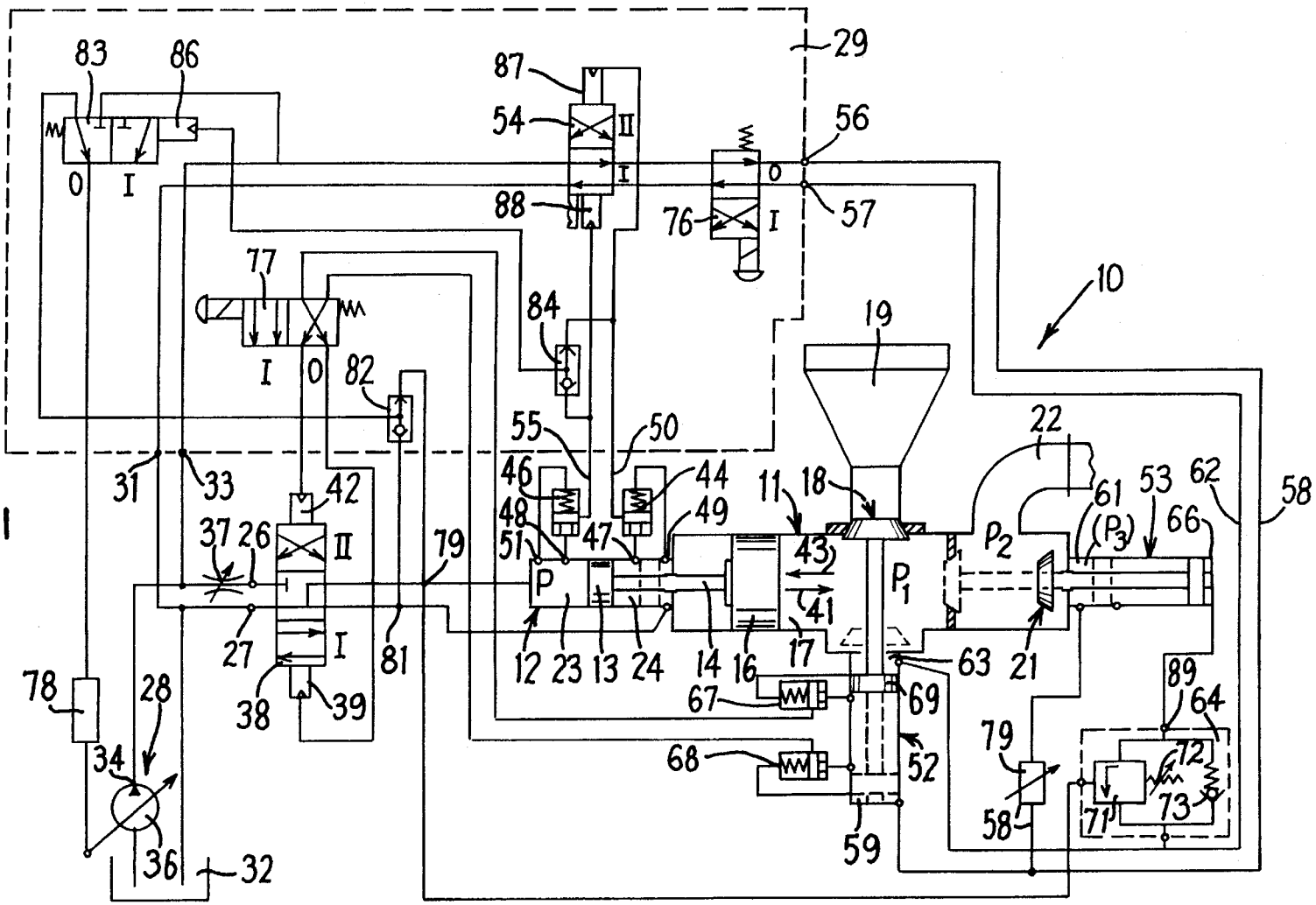
FIG. 1 illustrates a hydraulic schematic of a one-cylinder viscous fluid pump with a hydraulic control device of the invention.

A viscous fluid pump, for example a concrete pump, identified by reference number 10 and illustrated in FIG. 1 is designed as a one-cylinder pump. Pump 10 has a feed cylinder 11 which is driven by means of a—linear—drive cylinder 12. Cylinder 12 has a piston 13 which is rigidly connected to the piston 16 of the feed cylinder 11 through a piston rod 14. The piston 16 of the feed cylinder 11 forms the one-sidedly movable boundary of a feed chamber 17. Chamber 17 is connected communicatingly to a storage container 19 containing the goods to be transported. An inlet valve 18 regulates flow between the feed chamber 17 and the storage container 19. The feed chamber 17 is connected communicatingly to a feed line 22. An outlet valve identified by the reference numeral 21 controls the flow to and from the feed line 22.

The drive cylinder 12 is designed as a double-acting cylinder. Cylinder 12 has a bottom-side driving pressure chamber 23 and a rod-side driving pressure chamber 24. Chambers 23 and 24 are connected alternatively to a high-pressure (P)-supply connection 26 and a return (T) connection of a pressure-supply unit 28. Unit 28 is employed to supply pressure both to the hydraulic circuit formed by the drive cylinder 12 and to a control circuit 29. Control circuit 29 controls the sequence of the opening and closing of the inlet valve 18 and of the outlet valve 21. The return ($T_x$) connection 31 of the control circuit 29 and the return connection 27 of the load circuit are connected directly to the tank 32 of the pressure-supply unit 28. The control pressure ($P_x$) connection 33 of the control circuit 29 is connected directly to a pressure outlet port 34 of a high-pressure pump 36 of the pressure-supply unit 28. High-pressure pump 36 is designed as an adjusting pump, for example as an axial piston swivel disk pump. An adjustable throttle 37 is connected between a high-pressure outlet port 34 on the high-pressure pump 36 and the high-pressure (P)-supply connection 26 of the load circuit to effect a pressure load adjustment.

A main slide valve 38 is provided to control the movement of the drive-cylinder piston 13 and the associated feed-cylinder piston 16 so as to establish the periodic feed phases in the feed chamber 17. In the illustrated exemplary embodiment, slide valve 38 is a hydraulically servo-controlled 4/3-way valve. The main slide valve 38 has a "middle" base position O, in which both driving pressure chambers 23 and 24 of the drive cylinder 12 are relieved of pressure toward the tank 32 of the pressure-supply plant 28 and are blocked off from the high-pressure supply connection 26. The valve 38 has a first through-flow setting I assumed during the control pressure loading of a first control chamber 39 with control pressure $P_x$. When slide valve 38 is in this state, the high-pressure supply connection 26 of the load circuit is connected to the bottom-side driving pressure chamber 23 of the drive cylinder 12. The rod-side driving pressure chamber 24 of cylinder 12 is connected to the tank 32 of the pressure-supply unit 28. When these connections are established, the feed-cylinder piston 16 is driven in the sense of a reduction of the volume of the feed chamber 17, namely in direction of the arrow 41. The valve 38 has a second through-flow setting II assumed during loading of a second control chamber 42 with control pressure $P_x$. When slide valve 38 is in this state, the bottom-side driving pressure chamber 23 of the drive cylinder 12 is relieved of pressure toward the tank 32 of the pressure-supply plant 28, and the rod-side driving pressure chamber 24 of the drive cylinder 12 is loaded with the supply pressure accumulated at the high-pressure supply connection 26 of the load circuit. Consequently, the piston 16 of the feed cylinder 11 is driven in the sense of an enlargement of the volume of the feed chamber 17, namely in direction of the arrow 43.

The reversal of movement of the pistons 13 and 16 of the drive cylinder 12 and of the feed cylinder 11 occurs periodically during the operation of the viscous fluid pump 10. The movement of pistons 13 and 16 is monitored by a first hydraulic end-position indicator 44 which emits a high-pressure impulse when the piston 13 of the drive cylinder 12 has reached its end position indicated in dashed lines near the feed cylinder 11, and a second hydraulic end-position impulse transmitter 46 which emits a high-pressure control impulse when the piston 13 of the drive cylinder 12 reaches its end position near the bottom. The pressure-outlet impulses of the end-position impulse transmitters 44 and 46 trigger the needed reversal of the inlet valve 18 and of the outlet valve 21. Only after these valves 18 and 21 have assumed their open or closed position suited for the respective phase of the pump cycle, namely, the loading or the feeding phase, is the main slide valve 38 reversed.

The end-position impulse transmitters 44 and 46 are pressure-controlled one-way valves which include sensor inputs 47 and 48, respectively, which can be crossed by the piston 13 of the drive cylinder and can again be released in the respective end position of same, which sensor input 47 or 48 can be "crossed" by the piston 13 of the drive cylinder 12 and is again released in the respective end position of the piston 13. Transmitters 44 and 46 further include reference inputs 49 and 51, respectively, which cannot be crossed by the piston 13. Reference input 51 is attached to the bottom-side driving pressure chamber 23 and is connected to the first end-position impulse transmitter 46. Reference input 49 is attached to the rod-side pressure chamber 24 and is connected to the to transmitter 44. The end-position impulse transmitters 44 and 46 emit at their impulse outlets 50 and 55, respectively, output pressure impulses. End-position transmitters 44 and 46 only transmit pressure impulses only when between the reference input 49 and the sensor input 47 or the reference input 51 and the sensor input 48 there exists a pressure difference corresponding with the operating pressure P.

The inlet valve 18 and the outlet valve 21 are in the illustrated exemplary embodiment designed as disk-seat valves. Valves 18 and 21 are each controlled by a double-acting hydraulic cylinder 52 and 53, respectively, which operate in a push-pull mode. The simultaneous operation of the valves being such that the inlet valve 18 is in its blocking position while the outlet valve 21 is open and valve 21 is changed over into its blocking position, while the inlet valve 18 is open. Within control circuit 29 there is provided an operating control valve 54 which is set by the end-position pressure impulses of the end-impulse transmitters 44 and 46.

This operating control valve 54 is designed as a 4/2-way valve, through the changeover of which between its alternative through-flow positions I and II the control connections 56 and 57 of the control circuit can be changed alternatively to control-pressure level $P_x$ or tank level. According to the illustration, FIG. 1, when control valve 54 is in position I, upper control connection 56 is connected through a first control line 58 to the bottom-side control chamber 59 of the differential cylinder 52. The pressurized fluid then flows from tank 32, through valve, 54, connection 56 and control line 58 into the differential cylinder which results in the pressure loading of inlet valve 18 until valve 18 reaches its closing position blocking off the storage container 19 against the feed chamber 17. The pressurized fluid also flows through a control-line branch 58' that extends from the first control line 58 to the rod-side control chamber 61 of the differential cylinder 53 provided for operating the outlet valve 21. This fluid flow results in the pressure loading of which the outlet valve 21 so that valve 21 reaches its open position connecting the feed chamber 17 to the feed line 22.

The second control connection, control connection 57, regulated by control valve 54 of the control circuit 29 is connected through a second control line 62 to the rod-side control chamber 63 of the differential cylinder 52. This connection is provided for pressure loading of which the inlet valve 18 so that the valve reaches its open position connecting the storage container 19 to the feed chamber 17. The fluid supplied through second control line 62 is also applied through a changeover control device identified in its entirety by the reference numeral 64 to the bottom-side control chamber 66 of the differential cylinder 53. This fluid is provided for operating the outlet valve 21, through the pressure loading with control pressure $P_x$ so that the outlet valve 21 reaches its closed position blocking the feed chamber 17 of the feed cylinder 11 from the feed line 22.

The changeover control device 64, which will be discussed in greater detail hereinafter, has the function that indeed the pressure connection into the bottom-side control chamber 66 of the drive differential cylinder 53 of the outlet valve 21 occurs simultaneously with the pressure connection into the rod-side control chamber 63 of the drive differential cylinder 52 of the inlet valve 18. Consequently, when the pump 10 works in the feed operation, that is, the material flow is guided pulsatingly from the storage container 19 to the feed line 22, the outlet valve 21 opens only when a pressure corresponding at least approximately with the pressure existing in the feed line 22 is built up in the feed chamber 17.

The settings of the main slide valve 38, which controls the movement of the drive cylinder 12, are based on the end-position pressure impulses of end-position pressure-impulse transmitters 67 and 68 which are, respectively, attached to the top and bottom ends of differential cylinder 52. End position transmitters 67 and 68 are analogous in design and function to the end-position impulse transmitters 44 and 46 of the drive cylinder 12. More specifically, both transmitters 67 and 68 monitor the changeover of piston 69, transmitter 67 being associated with rod side control chamber 63 and transmitter 68 be associated with the bottom side control chamber 59. When pump 10 is in operation, main slide member 38 during the feeding operation is switched into its operating position I by an output impulse of the end-position impulse transmitter 67. The transmission of an pulse by transmitter 67 occurs when the inlet valve 18 reaches its blocking position. Specifically, main slide valve 38 is set in position I by the pressure loading its first control chamber 39 in response to valve 18 reaching its blocking, or closed position. Once slide valve 38 is set in position I, the pressurized fluid accumulated at the operating-pressure supply connection 26 is connected into the bottom-side driving pressure chamber 23 of the drive cylinder 12. When slide valve 38 is set in this position, the rod-side pressure chamber 24 of drive cylinder 12 is simultaneously connected to the tank 32 of the pressure-supply plant so that the pistons 13 and 16 of the drive cylinder 12 and of the feed cylinder 11 are displaced in feeding direction 41. Main slide switch 38 is switched to operating position II in response to an output impulse from the second end-position impulse transmitter 68 of the differential cylinder 52. This pulse occurs as a result of the changeover of the inlet valve 18 during the feeding operation of the pump 10. When main slide valve 38 is set in position II, the bottom-side driving pressure chamber 23 of the drive cylinder 12 is relieved of pressure toward the tank 32 of the pressure-supply plant 28. Simultaneously, the rod-side driving pressure chamber 24 of the drive cylinder 12 is loaded with the fluid charge to the operating pressure P. Collectively, these actions cause the pistons 13 and 16 of the drive cylinder 12 and of the feed cylinder 11 to be displaced in the direction of arrow 43 associated with a loading phase of the feed chamber 17.

The inlet valve 18 is open and the outlet valve 21 is closed during this phase of movement of the feed-cylinder piston 16.

To discuss the function of the viscous fluid pump 10 and its control device in greater detail, an initial situation corresponding with the feeding operation will now be described. In this situation, the piston 16 of the feed cylinder 11 carries out a feeding stroke, that is the piston 13 of the drive cylinder 12 is loaded on the bottom side with fluid charged to the operating pressure P from the adjustable throttle 37 through the main slide valve 38, which is in its operating position I. (The valve 38 was switched earlier into this operating position I by the end-position pressure impulse produced by the end-position impulse transmitter 67 upon reaching the closing position of the inlet valve 18.) When the pump 10 is in this state, the rod-side driving pressure chamber 24 of the drive cylinder is relieved of pressure, the inlet valve 18 assumes its blocking position shown in full lines and the outlet valve 21 assumes its open position shown in full lines. The control-pressure loading of the bottom-side control chamber 59 needed in this respect and the relief of pressure of the rod-side control chamber 63 of the operating cylinder 52 of the inlet valve and the control-pressure loading of the rod-side control chamber 61 and pressure relief of the bottom-side control chamber 66 of the changeover cylinder 53 of the outlet valve had thereby been achieved by the changeover of the operating control valve 54 into its operating position I, which changeover occurred during passage through the bottom side end position of the drive-cylinder piston 13 and was triggered by the output impulse of the end-position impulse transmitter 46.

From its initial position corresponding to the illustration of FIG. 1, the piston 13 of the drive cylinder 12 moves towards its end position on the side of the feed cylinder. Shortly before piston 13 reaches its end position, the first end-position impulse transmitter 44 produces a changeover impulse which is transmitted to the operating control valve 54. Valve 54 which is in position I, is then switched into its operating position II. When valve 54 is in this position, the control pressure $P_x$ now becomes present at the control connection 57 and the control connection 56 of the control circuit 29 is relieved of pressure toward the tank 32. Thus, while the drive-cylinder piston 13 continues to move toward its end position on the side of the feed cylinder, the rod-side control chamber 63 of the changeover cylinder 52 of the inlet valve 18 is charged with pressurized fluid through the second control line 62 and the bottom-side control chamber 66 of the changeover cylinder 53 of the outlet valve 21 is loaded through the changeover control device 64 with fluid pressurized to control pressure $P_x$. At the same time, the bottom side control chamber 59 of the changeover cylinder 52 of the inlet valve 18 and the rod-side control chamber 61 of the changeover cylinder 53 of the outlet valve 21 are relieved of pressure through the first control line 58, causing the inlet valve 18 to open and the outlet valve 21 to close. Consequently, these changeover operations of the inlet and outlet valves occurring very quickly.

When piston 69 reaches its end position, which corresponds to reaching the maximum opening cross section of the inlet valve 18, an end-position outlet impulse from the bottom-side end-position impulse transmitter 68 is produced. This impulse is transmitted to through which the main slide valve 38 so as to cause valve 38 to switch into its operating position II. When the main slide valve is in this position, the bottom-side driving pressure chamber 23 of the drive cylinder 12 is relieved of pressure and its rod-side driving pressure chamber 24 is charged with fluid at the operating pressure P. The feed-cylinder piston 16 carries out now its loading stroke occurring in direction of the arrow 43, during which goods to be transported flows from the storage container 19 into the enlarging feed chamber 17 because the closed outlet valve 21 is blocked off from the feed line 22.

With the piston 13 of the drive cylinder 12 approaches its bottom-side end position, that is, directly before it reaches this end position, the second end-position impulse transmitter 46 of the drive cylinder 12 produces an output impulse. This impulse is applied to operating control valve 54 so as to cause the valve to return to its operating position I. Consequently, high control pressure $P_x$ fluid becomes present again at the control connection 56 and reaches through the first control line 58 against the bottom-side control chamber 59 of the changeover cylinder of the inlet valve 18 and, through the control-line path 58', the rod-side control chamber 61 of the changeover cylinder 53 of the outlet valve 21. Since the rod-side control chamber 63 of the changeover cylinder 52 is connected through the second control line 62 and the operating control valve 54 again directly to the—pressureless—tank 32 the inlet valve 18 immediately transfers again into its closing position blocking off the storage container 19 from the feed chamber 17. Upon reaching the closing position, the rod-side end-position impulse transmitter 67 produces a pressure outlet impulse, through which the main slide valve 38 is again switched into the operating position I associated with the feeding operation of the drive cylinder 13, thus starting the feeding stroke of the piston 16 of the feed cylinder 11, which feeding stroke occurs in direction of the arrow 41.

In contrast to the inlet valve 18, which, practically simultaneously with the switching of the operating control valve 54 into its operating position I, reaches its blocking position, the opening of the outlet valve 21 is delayed. This occurs because of the action of the changeover control device 64, until the operating pressure in the bottom-side driving pressure chamber 23 of the drive cylinder 12 and thus also the pressure in the feed chamber 17 reaches a minimum value and pressure medium can only thereafter flow from the bottom-side control chamber 66 of the changeover cylinder 53 of the outlet valve 21 toward the tank 28.

The changeover control device 64 of the illustrated version of the invention includes a pressure valve 71, which is urged by a valve spring 72 with an adjustable initial tension into its blocking position. Valve 71 is loaded in its opening direction by the operating pressure P building up in the bottom-side driving pressure chamber 23 of the drive cylinder 12 during the feeding operation. The fluid charged to pressure P is supplied to valve 71 from a pickup point 79 between the main slide valve 38 and the drive cylinder 12. Changeover control device 64 further includes a check valve 73 connected in parallel with the pressure valve 71, with this parallel connection existing between a bottom-side connection of the changeover cylinder 53 of the outlet valve 21 and the second control line 62. The check valve 73 being poled through a relatively higher pressure in the bottom-side control chamber 66 of the changeover cylinder 53 of the outlet valve 21 in blocking direction and through a relatively higher pressure in the second control line 62 in passing direction. The pressure utilized for the open-control of the pressure valve 71 can also be picked up directly at the outlet 34 of the high-pressure pump 36, or also "somewhere" between said valve and the drive cylinder 12 or at another pressure line connected to the bottom-side driving pressure chamber of the drive cylinder 12.

By adjusting the initial tension of the valve spring 72, it is possible to adjust the "opening pressure" at which the pressure valve 71 reaches its open position. An advantageous adjustment is thereby that the pressure valve 71 opens when the pressure $P_1$ building up in the feed chamber 17 at the start of the feeding stroke of the piston 16 of the feed cylinder 11 has the same or approximately the same value as the pressure $P_2$ existing in the feed line 22. When this relationship is reached by adjusting the initial tension of the valve spring 72, then an optimum quiet pump operation is achieved since then, when the outlet valve 21 opens, no return flow from the feed line 22 into the feed chamber 17 or a sudden relaxation of the same toward the feed line 22 occurs, which would be linked to an undesired noise development and also wear-promoting vibrations of the pump 10.

Figure 1A:
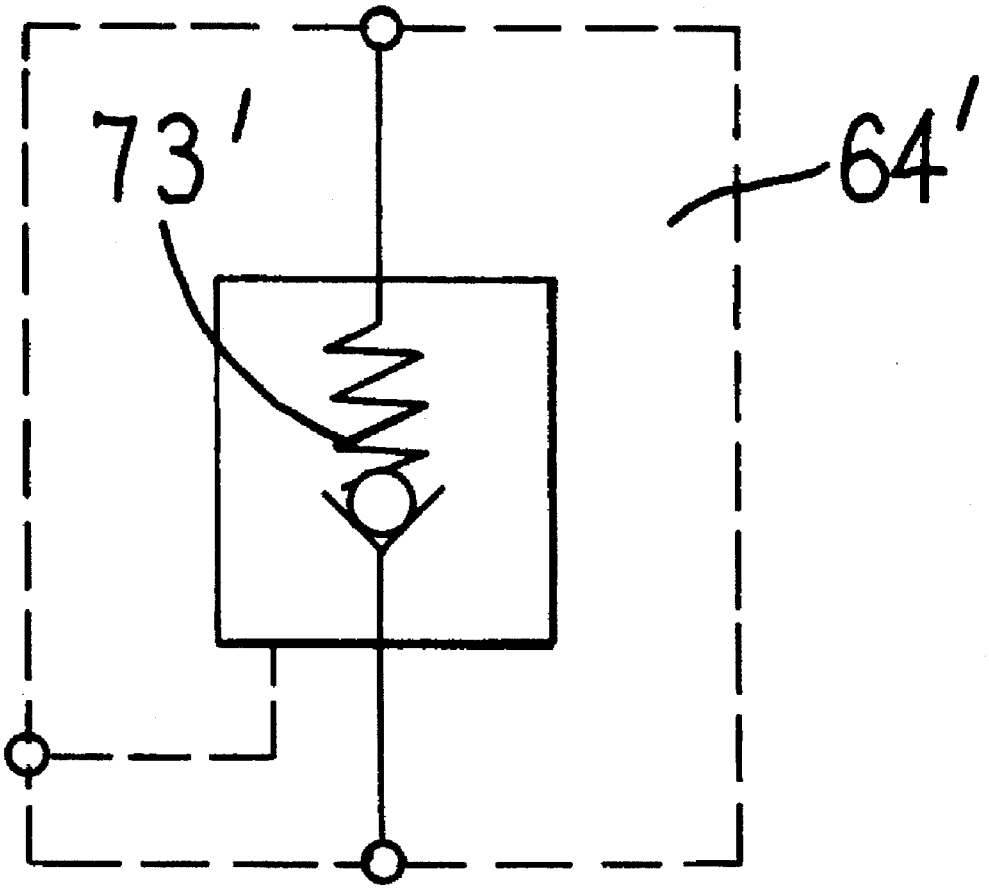
FIG. 1*a* illustrates a design of a changeover control device for an outlet valve provided within the scope of the hydraulic control device, which design is an alternative to the exemplary embodiment according to FIG. 1.
Figure 1C:
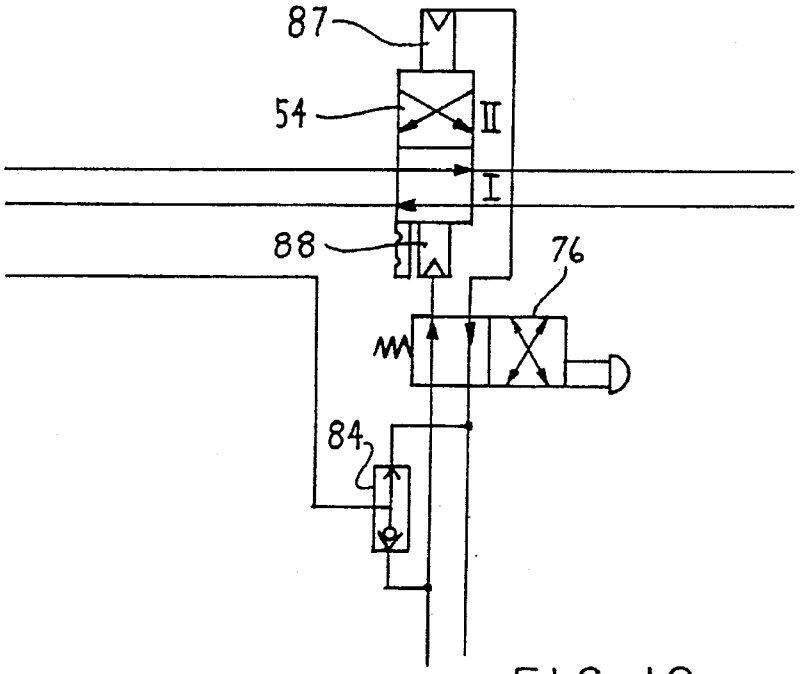
FIG. 1*c* illustrates alternative placement of the operational changeover valve for controlling the forward/reverse fluid flow of the pump of this invention.
Figure 1B:
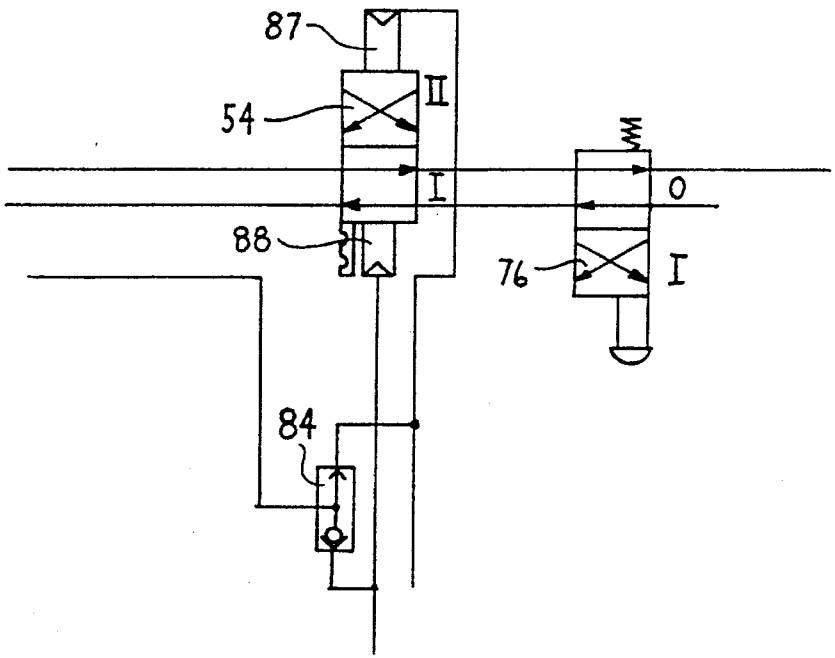
FIG. 1*b* illustrates an end position sensor that can be mounted to the rod side of the outlet valve control chamber in order to provide a signal indicating that the outlet valve is in the fully boxed state according to an alternate design of this invention.

In place of the pressure valve 71 freeing an increasing opening cross section with an increasing operating pressure P after exceeding the minimum opening pressure and of the check valve 73 connected in parallel thereto, an alternative changeover device 64' is shown in the detailed illustration of FIG. 1*a*. Changeover device 64' includes a pressure-remote-controlled check valve 73', which combines the function of the check valve 73 and of the pressure valve 71 of the changeover control device 64 of FIG. 1 in one structural element valve 73' however, has a different—"step-like"—changeover characteristic compared with the changeover control device 64 due to the fact that as soon as it opens, the valve 73' assumes immediately an open state with a maximum opening cross section.

To influence the opening behavior of the outlet valve 21, a pressure reducer 74 is also suited with which, in a definite, if necessary adjustably changeable reducing ratio $i_{min}$ in relation to the operating pressure P, which exists in the bottom-side driving pressure chamber 23 of the drive cylinder 12, or to the pressure $P_1$ which builds up in the feed chamber 17 during a feed phase of one pump cycle. Pressure reducer 74 is employed to adjust the pressure $P_3$ to support the opening of the outlet valve 21 into the rod-side control chamber 61 of the changeover cylinder 53 of the outlet valve 21. The pressure reducer 74 is connected to the first control line 58 through a control-line path 58'.

In place of the end-position impulse transmitter 68, which is associated with the inlet 18 and which, when the piston 69 of the changeover cylinder 52 of the inlet valve 18 reaches its bottom-side end position, produces an impulse to change over the main slide valve 38, it is possible to utilize, as shown in dashed lines, an end-position impulse transmitter 68' associated with the outlet valve 21, which produces an outlet impulse. The pulse generated by end-position transmitter 68' can be used to initiate the changeover of the main slide member 38 when the outlet valve 21 reaches its closing position, which would have to take place like the hydraulic control of the changeover cylinders 53 and 52 of the outlet valve 21 and of the inlet valve 18 as a rule simultaneously with reaching the open position of the inlet valve 18. Since, however, attaining the closed position of the outlet valve 21 can be slightly delayed compared with attaining the open position of the inlet valve 18, it is particularly advantageous to utilize the outlet impulse of the end-position impulse transmitter 68' which outlet impulse is characteristic for attaining the closed position of the outlet valve 21, to change over the main slide member 38 so that it is assured during the course of the sequence control that the main slide valve 38 does not change over until the outlet valve 21 has reached this closed position.

In order to be able to also use the viscous fluid pump 10 when necessary in a return operating mode, in which goods to be transported is pumped from the feed line 22 back into the storage container 19, a first operational changeover valve 76 is provided. Valve 76 is connected between the operating control valve 54 and the two control lines 58 and 62. A second operational changeover valve 77, through which the outlet impulses of the end-position impulse transmitters 67 and 68 or 68' can be fed to the control chambers 39 and 42 of the main slide valve 38 is also provided to facilitate reverse or reverse operation of the pump.

The operational changeover valves 76 and 77 are designed as 4/2-way valves and have spring-centered base positions O associated with the feeding operation. Through a common, electrical or manual operation,valves 76 and 77 are switched to "activated" operating positions I, in which the changeover operations of the inlet valve 18 and of the outlet valve 21 are synchronized with the operating strokes of the drive cylinder 12 and of the feed cylinder 11 such that the goods to be transported is returned from the return line 22 into the storage container 19.

The high-pressure pump 36 of the pressure-supply plant 28, which high-pressure pump is a control pump, has an only schematically indicated control member 78. Control member 78, the design and function of which is known, performs a load-sensing operation of the high-pressure pump 36 so that during the operation of the viscous fluid pump, the hydraulic oil volume stream flowing through the throttle 37 is timely constant, which corresponds with a control of the viscous fluid pump 10 to a constant material flow during the feeding and loading phases of the pump cycles. This control takes place in dependency of the respective operating pressure, which is picked up in the direct vicinity of the driving pressure chambers at pickup points 79 and 81 and is fed through a changeover check valve 82 and a control valve 83 to the control member 78. This control valve 83 is in the illustrated exemplary embodiment designed as a pressure-controlled 3/2-way valve, the spring-centered base position O of which is a through-flow position, in which the operating pressures guided through the changeover check valve 82 to the control valve 83 are forwarded to the control member 78.

Through the end-position output impulses of the end-position pressure impulse transmitters 44 and 46 of the drive cylinder 12, which through a further changeover check valve 84 are guided to the control chamber 86 of the control valve 83, the valve is changed during the movement changeover operations of the drive cylinder 12 to its operating position I. When control valve 83 is in operating position I, the maximum control pressure $P_x$ is active at the control member 78 so that in these movement reversing phases the control pump 36 operates with a maximum feed performance.

The switching arrangement of the first operational changeover valve 76 "between" the operating control valve 54 and the control connections 56 of the control system 29, shown in full lines, is equivalent in function to a switching arrangement of this valve 76 "between" the end-position impulse transmitters 44 and 46 of the drive cylinder 12 and the operating control valve 54, shown in dashed lines When changeover valve 76 is so repositioned, the base position of the valve 76 is such that the end-position signal outlet 50 of the first end-position impulse transmitter 44 is connected to the control chamber 87, through the pressure loading of which the operating control valve 54 is switched into its operating position II. The impulse outlet 55 is connected to the control chamber 88 of the operating control valve 54, through the pressure loading of which control chamber the operating control valve 54 is switched into its operating position I.

The hydraulic switching arrangement including the main slide valve 38, the operating control valve 54, the operational changeover valves 76 and 77, the two changeover check valves 82 and 84 and the pump control valve 83 are combined in a particularly advantageous design to form one hydraulic block identified in its entirety by the reference numeral 90. Hydraulic block 90 can be utilized with the design discussed in detail in connection with FIG. 1 also for the pressure supply and valve control for a two-cylinder viscous fluid pump. Such pump, for example, can include two pumps of the type described in connection with FIG. 1 operating in a push-pull manner. The feed lines 22 of the individual pumps start out from the feed chambers 17, end in a so-called "Y-pipe arrangement" in one single, not illustrated, extended feed line, in which the stream of material flows essentially continuously.

Figure 2:
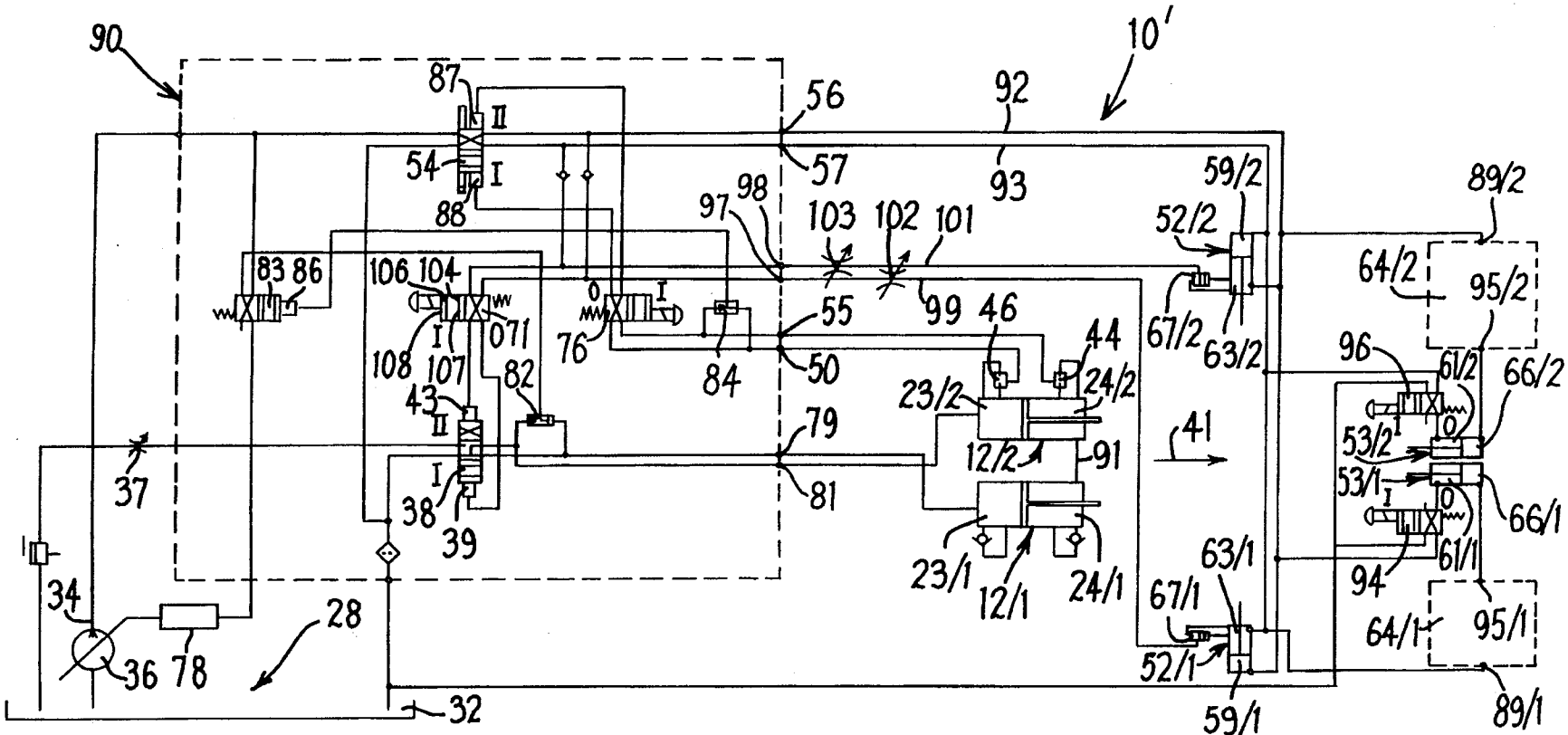
FIG. 2 illustrates a hydraulic schematic of a further exemplary embodiment of a hydraulic control device of the invention for a two-cylinder viscous fluid pump, in which for each feed cylinder there is provided an inlet and an outlet valve.

Such a pump 10' is represented in FIG. 2, includes two drive cylinders 12 and associated feed cylinders 11. Each feed cylinder 11 has an inlet valve and an outlet valve and a changeover control device, the details of which will now be discussed. For reasons of simplicity, pump 10' is described as having two drive cylinders 12/1 and 12/2, two double-acting differential cylinders 52/1 and 52/2 that control the inlet valves into and out of each of the feed chambers 11, two differential cylinders 53/1 and 53/2 for controlling the opening and closing movements of the feed chamber outlet valves and two changeover control devices 64/1 and 64/2.

As far as the same reference numerals are used for parts of FIGS. 1 and 2, this makes reference to structural and functional equality and/or analogy and at the same time refer to the above description portion relating thereto.

The bottom-side driving pressure chambers 23/1 and 23/2 of the two drive cylinders 12/1 and 12/2 are attached to the individual outlet ends of main slide valve 38 through outlet connections 79 and 81, respectively, of the hydraulic block 90. The outlet connections 81 and 79 also form the pickup points, where by means of the changeover check valve 82 the respective operating pressure is picked up and is fed to the control member 78 of the control pump 36. The two rod-side driving pressure chambers 24/1 and 24/2 of the two drive cylinders 12/1 and 12/2 are in constant communication with one another through a crossline 91. In a functionally equivalent design of the viscous fluid pump 10' in place of the bottom-side driving pressure chambers 23/1 and 23/2 of the drive cylinders 12/1 and 12/2, their rod-side driving pressure chambers 24/1 and 24/2 could be connected to the outlet connections 81 or 79 of the hydraulic motor 90 and instead their bottom-side driving pressure chambers 23/1 and 23/2 could be connected to one another through a "rocker oil line" corresponding in function with the crossline 91.

Viewed in the common feeding direction 41 of the drive cylinders 12/1 and 12/2, which are arranged axially parallel only for the purpose of the description, the left drive cylinder 12/2 has pressure-impulse transmitters corresponding in design and function with the end-position impulse transmitters 44 and 46. The signal outlets 55 and 50 of the pressure-impulse transmitters are connected to the correspondingly identified connecting points of the hydraulic block 90, from where the end-position outlet impulses are guided through the changeover check valve 84 to the control chamber 86 of the control valve 83. These impulses regulate the setting of valve 83 which, in turn, adjusts pump 36 for maximum feed performance by regulation of the control member 78. The output impulses of end-position impulse transmitters 44 and 46 are transmitted through the first operational changeover valve 76 to the control chambers 87 and 88 of the operating control valve 54, are utilized for its changeover. The inlet valves and the outlet valves are, like in the exemplary embodiment according to FIG. 1, constructed in such a manner that they assume their blocking position when the bottom-side control chambers of their changeover cylinders 52/1 and 52/2 or 53/1 and 53/2 are loaded with the high control pressure $P_x$ fluid and their rod-side control chambers are relieved of pressure.

Control lines 92 and 93 are connected to control connections 56 and 57,respectively, of the hydraulic block 90. These control line connections can be reversed by switching the operating control valve 54 with respect to the pressure level—control pressure $P_x$ or tank pressure level—, through which control lines the inlet and outlet valves can be controlled in the necessary push-pull operation. The first control line, line 92, is coupled to the outlet port 34 of pump 36 to receive the high control pressure level $P_x$ fluid when control valve 54 is in operating position I. When valve 54 is in operating position II, line 92 is connected to the tank 32 of the pressure-supply plant 28. When valve 54 is in position II, tank 32 is directly connected to the rod-side control chamber 63/2 of the changeover cylinder 52/2 of the inlet valve of the "left" feed cylinder of the viscous fluid pump 10' and to the bottom-side control chamber 59/1 of the changeover cylinder 52/1 of the "right" feed cylinder of the pump 10'. When control valve 54 is in position II, pump 32 is also hydraulically connected through the changeover control device 64/2 to the bottom-side control chamber 66/2 of the changeover cylinder 53/2 of the outlet valve of the "left" feed cylinder.

The second control line, line 93, the line connected to control outlet 57 is directly connected to the bottom-side control chamber 59/2 of the changeover cylinder 52/2 of the inlet valve of the left feed cylinder and to the rod-side feed chamber 63/1 of the changeover cylinder 52/1 of the inlet valve of the right feed cylinder. Control line 93 is also hydraulically connected through the changeover control device 64/1 to the bottom-side control chamber 66/1 of the outlet valve of the right feed cylinder. The connections of the changeover control devices 64/1 and 64/2 on the side of the control line are identified by the reference numerals 89/1 and 89/2, their connections on the side of the control chamber by the reference numerals 95/1 and 95/2.

The rod-side control chambers 61/1 and 61/2 of the two changeover cylinders 53/1 and 53/2 are connected to the tank 32 of the pressure-supply plant 28 through individual changeover valves 94 and 96, respectively. When the valves 94 and 96 are in their base positions, position O, which is associated with the normal feeding operation of the viscous fluid pump 10', control chambers 61/1 and 61/2 are connected to the tank 32.

The inlet valve changeover cylinders 52/1 and 52/2 are each provided with a "rod-side" end-position-(pressure) impulse transmitter 67/1 or 67/2, which correspond with the end-position impulse transmitters 67 and 68 of the exemplary embodiment according to FIG. 1. Impulse transmitters 67/1 and 67/2 each emit a pressure-output impulse each time when the associated pistons of the changeover cylinders 52/1 or 52/2 reach their end position corresponding with the closed position of the respective inlet valve.

The pressure-output impulses of the end-position impulse transmitters 67/1 and 67/2, are guided alternatingly to the control chambers 39 and 42 by the second operational changeover valve 77. When valve 77 is in its base position, position O, during the feeding operation of the pump 10' it is switched in each case into such an operating position I or II so that the feed cylinder associated with the inlet valve 18 which is in the blocking position will urge to goods to be transported from the storage container into the associated feed line.

The signal outlets 55 and 50 of the end-position impulse transmitters 44 and 46 are connected through the first operational changeover valve 76 to the control chambers 87 and 88 of control valve 54 in the switching arrangement illustrated in FIG. 2.

When the pump 10' is supposed to operated in the return mode, in which goods to be transported is pumped from the feed line back into the storage container, the changeover valves 76 and 77 associated with the operating control valve 54 and the main slide valve 38 and changeover valves 95 and 96 associated with the outlet valves are switched from the illustrated base positions O to their alternative operating positions I. This switching can be done manually or be electrically controlled and should be done in such a manner that all operational control valves 76, 77, 94 and 96 are simultaneously switched.

In contrast to the feeding operation of the pump 10', during which the outlet valve rod-side control chambers 61/1 and 61/2 of the changeover cylinders 53/1 and 53/2 are connected to the tank 32 of the pressure-supply plant 28 through changeover valves 94 and 96, the chambers 61/1 and 61/2 are sequentially loaded during the return mode operation of the pump 10'. Specifically changeover valves 94 and 96 are reset so that rod-side control chambers 61/1 and 61/2 are alternating connected through the control lines 92 and 93 with the high control pressure $P_x$ fluid. In other words, the associated outlet valves are "actively" set into their open positions.

The switching of the outlet valves 21 into their blocking operating positions is done like during the feeding operation of the pump 10'. Specifically outlet valves 21 are set by the pressure loading of their bottom-side control chambers 66/1 and 66/2 through the changeover control devices 64/1 and 64/2 synchronously with the changeover of the inlet valves and in such a sequence that results in the reversal of the stream of material to be transported.

In order to assure that in the return-operation mode the main slide valve 38 is switched only after the inlet and outlet valves have reached their switched positions suited for reversed material-flow, the impulse-signal lines 99 and 101, which lead through control connections 97 and 98 and changeover valve 108 to main slide valve control chambers 39 and 42 are provided with adjustable throttles 102 and 103. By suitably adjusting the throttles 102 and 103, a delay in the changeover of the main slide valve 38 is achieved compared with the changeover of the inlet and outlet valves. This is of a particular importance for the return-operation mode, during which the outlet valves must be opened—alternatingly—against the material pressure accumulated in the feeding line, however, the opening of the outlet valves is not supported by the feeding operation of the feed cylinders.

Alternatively, or in addition to the adjustable throttles 102 and 103, it is also possible to provide the through-flow channels 104 and 106 of with the second operational changeover valve 77. The through-flow channels 104 and 106 are utilized during the reversing operation, with throttles 107 or 108, which then, however, can only be realized in a simple manner as fixed throttles.

Adjustable throttles 102 and 103 or fixed throttles 107 and 108 with this function can also be provided in the exemplary embodiment according to FIG. 1.

Figure 3:
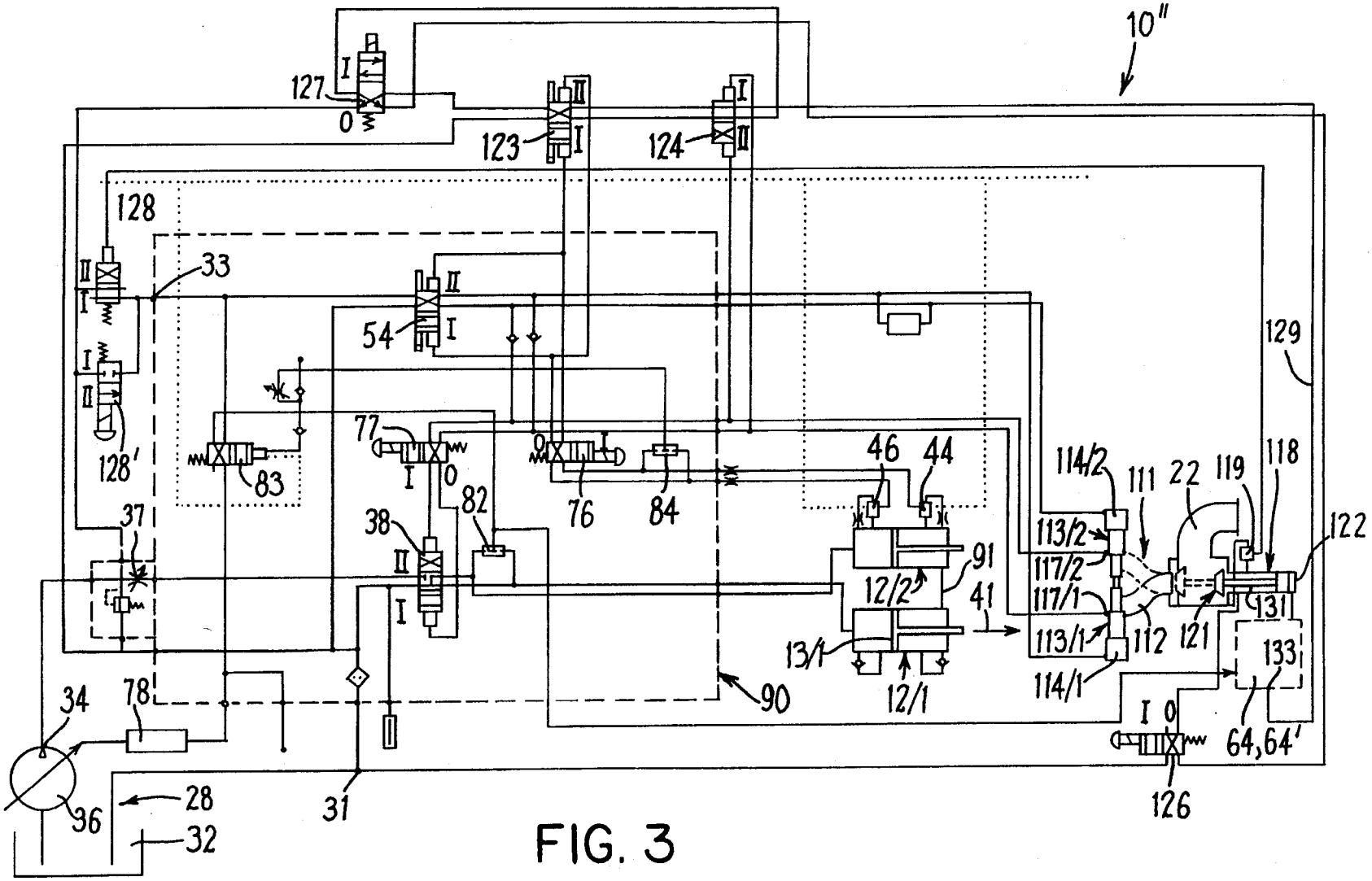
FIG. 3 illustrates a hydraulic schematic of a hydraulic control device of the invention for a two-cylinder viscous fluid pump having a S-tube switch for coupling of the two feed cylinders to a common feed line.

To discuss yet a further exemplary embodiment, reference is now made to FIG. 3 which shows a viscous fluid pump 10". Pump 10" is constructed as a two-cylinder pump and is identical to the exemplary embodiment according to FIG. 2 regarding the control of the drive cylinders 12/1 and 12/2 and their push-pull control using the hydraulic block 90. Pump 10" differs from pump 10' in that for the periodically alternating connection of the feed chambers, (not illustrated,) to a common feed line 22, a tube switch 111, namely, a swingable S-tube 112, is provided. Tube 112 is permanently connected to the feed line 22 and is connected in one of its two swivelled positions communicatingly with the feed chamber of the one feed cylinder, whereas the feed chamber of the other feed cylinder is connected to the storage container, and is connected in the other swivelled end position to the feed chamber of this feed cylinder.

Two changeover cylinders 113/1 and 113/2 acting in opposite direction are provided as the swivel drive for the tube switch 111. The pistons of cylinders cylinders 113/1 and 113/2 are positively flexibly connected to the S-tube 112 so that during alternating pressure loading and pressure relief of their drive chambers 114/1 and 114/2, respectively, work like a single double-acting hydraulic cylinder. The kinematic coupling of the tube switching changeover cylinders 113/1 and 113/2 to the S-tube 112 is such that the feed chamber of the left feed cylinder is connected through the S-tube 112 to the feed line 22 when the drive chamber 114/2 of the left changeover cylinder 113/2 is loaded with high pressure and the drive chamber 114/1 of the right changeover cylinder 113/1 is relieved of pressure and vice versa.

The changeover control of the changeover cylinders 113/1 and 113/2 of the tube switch 111 takes place analogously to the control of the changeover cylinders 52/1 and 52/2 of the inlet valves of the exemplary embodiment according to FIG. 2, with the hydraulic control block 90, discussed in connection with this exemplary embodiment and having the identical design and the same function, being utilized here with respect to the control of the changeover cylinders 113/1 and 113/2 also in the exemplary embodiment according to FIG. 3.

In as far as the operating elements of FIGS. 1, 2 and 3 have the same reference numerals, this is also supposed to indicate the reference to sameness in design and function or analogy of such elements and the reference to the respective above-disclosed description parts.

The changeover cylinders 113/1 and 113/2 have pressure outputs 117/1 and 117/2 functionally corresponding with the end-position impulse transmitters 67/1 and 67/2 which emit output signals when each time their associated pistons reach their end positions. Pressure outputs 117/1 and 117/2 are remote from the bottom, toward the respective drive chambers 114/1 and 114/2. Outlets 117/1 and 117/2 thus emit pressure signals at the level of the control pressure couplable into the driving chambers 114/1 and 114/2 that are forwarded to the main slide valve 38 to switched the valve 38 between its alternative operating positions I and II.

The feed line 22 can be blocked off from the S-tube for the duration of the tube-switch changeover operation by means of a shutoff device 121 designed analogously with respect to the outlet valve 21 according to FIG. 1. A differential cylinder 118 is provided for driving the shutoff device 121. Differential cylinder 118 has an end-position impulse transmitter 119 which emits its output pressure impulse when the shutoff device 121, after the pressure loading of the bottom-side control chamber 122 of the differential cylinder 118 with the control pressure $P_x$, fluid reaches its end position blocking off the S-tube 112 from the feed line 22.

For the operatively correct control of the differential cylinder 118 of shutoff device 121, there are provided a closing control valve 123, an opening control valve 124, and two operational changeover valves 126 and 127. Valves 126 and 127 are designed as 4/2-way valves with spring-centered base positions O in which the valves are positioned during normal feeding operation. Valves 126 and 127 also have operating positions I in which they are set during the return operation of the viscous fluid pump 10". A pressure-controlled supply control valve 128, for controlling the flow of fluid to the tube-switch drives 113/1, 113/2, is also provided. Valve 128 establishes a connection to the tube switch drives 113/1 and 113/2 only when and as long as the end-position pressure impulse of the end-position impulse transmitter 119 of the differential cylinder of the shutoff device 121 brings about a connection of the high-pressure outlet port 34 of the pump 36 with the control-pressure connection 33 so that through this the time span is defined within which the tube switch 111 is switched. The high-pressure pump 36 is also adjusted within this time span through the control valve 83 to a maximum feed performance. An additional operational changeover valve, which can be switched manually or electrically controlled, is 2/2-way valve 128' which is connected hydraulically in parallel with the supply control valve 128. is provided, which valve 128' has a blocking position I associated with the feeding operation and a through-flow position II associated with the return operation in which the pressure outlet port 34 of the high-pressure pump 36 is connected to the control connection 33 of the hydraulic block 90. Operationally equivalent with this would be the insertion of such a 2/2-way valve between the high-pressure outlet port 34 of the pump 36 and the control chamber of the supply control valve 128.

The functional coordination of these valves provided in addition to the exemplary embodiment according to FIG. 3 will be discussed in detail hereinafter in connection with one operating cycle of the viscous fluid pump 10".

A situation is assumed, in which the "right" feed cylinder of the viscous fluid pump 10" carries out its feeding stroke and the piston 13/1 of its drive cylinder 12/1 moves to the "right" in direction of the arrow 41. The driving chamber 114/1 of the right changeover cylinder 113/1 of the tube switch 111 is, in this situation, loaded with pressurized fluid. The feeding chamber of the right feed cylinder is connected through the S-tube 112 of the tube switch 111 to the feed line 22. The shutoff device 121 is open, that is, the bottom-side driving chamber 122 of the differential cylinder 118 of the shutoff device 121 is relieved toward the tank 32 of the pressure-supply plant 28 through the changeover control device 64 or 64' connected to the drive chamber 122. The control line 129 is connected to the changeover control device 64 or 64' and the opening control valve 124 and the closing control valve 123 are in their illustrated operating positions.

This situation was preceded by the transmission of the end-position signal at the pressure outlet 117/1 of the right changeover cylinder 113/1. This signal is transmitted to the opening control valve 124 to cause valve 124 to switch to its illustrated operating position I, which corresponds with the "parallel" course of its through-flow channels. The signal from outlet 117/1 was also transmitted to the main slide valve 38 so as to have caused it to switch into its operating position II, which corresponds with the "crossed" extent of its through-flow channels. The situation was also preceded by the transmission of the end-position impulse of the end-position impulse transmitter 44 reacting to the end of the feeding stroke of the left drive cylinder 12/2 of the viscous fluid pump 10". The impulse from the end-position impulse transmitter 44 was applied to the closing control valve 123 switch into its illustrated operating position II, which corresponds with the "crossed" extent of its control channels in the circuit symbol. The output impulses from transmitter 44 was also applied to operating control valve 54 to switch the valve 54 into its operating position I, which corresponds with the "parallel" extent of its through-flow channels in the circuit symbol. The consequence of these valve operating positions is the assumed initial situation, in which the right feed cylinder carries out its feeding stroke and the left feed cylinder its loading stroke.

During the course of the feeding phase of the right feed cylinder, which is the loading phase of the left feed cylinder, the piston of the drive cylinder 12/2 of the left feed cylinder reaches its end position near the bottom. This causes the end-position impulse transmitter 46 to emit a pressure-output impulse. This impulse is transmitted to operating control valve 54 to cause valve 54 to switch into its operating position II, which in the circuit symbol corresponds with the crossed extent of the through-flow paths. The impulse from transmitter 46 is also applied to the closing control valve 123 to cause valve 123 to switch into its operating position I, which in the circuit symbol corresponds with the parallel extent of its through-flow paths.

The first consequence of this is that the shutoff device 121 reaches its blocking position since the control line 129, which is loaded with a high control pressure fluid, is coupled through the changeover control device 64 or 64' into the bottom-side driving chamber 122 of the differential cylinder 118 of the shutoff device 121. The consequence of this is in turn that with the shutoff device 121 moves into its blocking position. This movement, in turn, causes the end-position impulse transmitter 119 of the differential cylinder 118 of the shutoff device 121 to produce its pressure-output impulse characteristic for the closing position of the shutoff device 121. The impulse from transmitter 119 is applied to supply control valve 128 to cause valve 128 to switch into its operating position II corresponding to the crossed extent of its through-flow paths in the circuit symbol. When valve 128 is in operating position II, the high control pressure $P_x$ fluid becomes present at the operating control valve 54, which is in operating position II. Since valve 54 is in position II, the high pressure fluid is applied to the driving chamber 114/2 of the left changeover cylinder 113/2 of the tube switch 111. This causes switch 111 to switch the position of its S-tube 122 so that it connectes the feed chamber of the left feed cylinder to the feedline 22. Once this changeover occurs, a pressure-outlet signal is emitted at the pressure outlet 117/2 of the left changeover cylinder 113/2 of the tube switch. This pressure-outlet signal switches the opening control valve 124 into the operating position II corresponding in the circuit symbol to the crossed extent of its through-flow paths. At the same, the signal from outlet 117/2 switches the main slide valve 38 into its operating position I corresponding in the circuit symbol to the parallel extent of its through-flow paths. By switching the opening control valve 124, the driving chamber 122 of the differential cylinder 118 of the shutoff device 121 is again relieved of pressure so that the shutoff device 121 can open again. The operating pressure P is coupled through the main slide valve 38, which is in operating position I, into the bottom-side driving chamber 23/2 of the left drive cylinder 12/2 of the viscous fluid pump 10", which causes the left feed cylinder to now operate in the feeding operation, while the right feed cylinder 12/1 carries out its loading stroke.

The up to now discussed operation is repeated as soon as the piston of the drive cylinder 12/2 of the left feed cylinder moves into the vicinity of its end position remote from the bottom and the end-position pressure-impulse transmitter 44 reacting to this end position emits a pressure impulse.

The changeover of the viscous fluid pump 10" according to FIG. 3 to the return-operation mode, in which viscous fluid is pumped from the feed line 22 back into the storage container, is done by simultaneously switching the operational changeover valves 76 and 77 or 126 and 127 from their spring-centered base positions O, which correspond in each of the circuit symbols to the crossed extent of their through-flow paths, into their operating positions I corresponding to the parallel extent of their through-flow paths in the circuit symbol, and the operational changeover valve 128' designed as a 2/2-way valve into its through-flow position II. The changeover of the operational changeover valves 126 and 127 associated with the tube switch 111 causes, in the return-operation mode of the viscous fluid pump 10", the shutoff device 121 to permanently assume its open position, since operational changeover valve 127 actes as a bypass valve in this mode of operation, in the operating position I of which valve 127 the closing control valve and the opening control valve are bridged through a bypass path, and the second operational changeover valve 126, which is in its operating position I and associated with the tube switch 111, to keep the rod-side driving chamber 131 loaded permanently with the high control pressure $P_x$ fluid. At the same time, bottom-side control chamber 122 of the differential cylinder 118 of the shutoff device 121 is relieved toward the pressureless tank 32 of the pressure-supply plant and, through the switching of the 2/2-way valve 128' into its through-flow position II, the pressure supply of the changeover cylinders 113/1 and 113/2 of the tube switch 111 is assured.

In as far as above the end-position impulse transmitters and valves intended for the sequence control of the feeding and returning operation of the viscous fluid pumps 10, 10' and 10" are designed as hydraulic impulse transmitters and valves hydraulically controllable by means of these impulse, transmitters, it is possible to utilize in their place and for the same purpose also electrical impulse transmitters and electrically controllable valves.

We claim:

1. A hydraulic control device for a viscous fluid pump comprising:

at least one feed cylinder drivable by means of a hydraulic cylinder, the feed cylinder including a feed chamber that is connected alternatingly to a storage container through a hydraulically operable inlet valve and to a feed line through a hydraulically operable outlet valve and a feed chamber piston that controls the volume of the feed chamber, the feed chamber piston being coupled to the hydraulic cylinder, the feed cylinder having a loading phase in which the feed chamber piston increases the volume of the feed chamber, the inlet valve is open and the outlet valve is closed, and a feeding phase in which the feed chamber piston reduces the volume of the feed chamber, the outlet valve is open and the inlet valve is closed;

a pump drive connected to the hydraulic cylinder for controlling the position of the piston in the feed chamber by selectively applying pressurized fluid to the hydraulic cylinder to actuate the feed chamber piston; and a sequence controller which controls the changeover of the inlet and the outlet valves and the pump drive, the sequence controller including a changeover control device acting on the outlet valve, the changeover control device being configured so that after the feed chamber piston performs the feeding phase, the changeover control device holds the outlet valve in its blocking position until an adjustably preset pressure threshold is reached in the feed chamber the threshold corresponding at least approximately with the pressure existing in the feed line, and upon reaching the pressure threshold, the changeover control device sets the outlet valve into its through-flow position, this changeover being caused by valve-controlled pressure relief of an outlet valve control-cylinder pressure chamber, characterized in that the changeover control device which controls the pressure relief of the pressure chamber of the outlet valve control cylinder is designed as an electrically or hydraulically operable valve controlled by the high pressure produced by the pressure loading of the feed cylinder, the pressure-controlled valve being set so when the pressure in the feed cylinder hydraulic cylinder reaches an adjustably preset minimum value of pressure, the pressure-controlled valve switches the outlet valve into the outlet valve through-flow position.

2. The hydraulic control device according to claim 1, characterized in that the control valve is designed as a pressure-controlled through-flow valve to which a check valve is connected in parallel, the check valve being loaded in an opening direction through higher pressure at its connection remote from the outlet valve control cylinder than at its connection to a driving pressure chamber section of the outlet valve control cylinder.

3. The hydraulic control device according to claim 1, characterized in that the relief control valve is designed as a proportional valve with which is connected in parallel a check valve, the check valve being loaded in opening direction through higher pressure at its connection facing the outlet valve control cylinder than in the driving pressure chamber of the outlet valve control cylinder.

4. The hydraulic control device according to claim 1, characterized in that the relief control valve is designed as a remote-control check valve which is loaded in a blocking direction through relatively higher pressure in the driving chamber of the outlet valve control cylinder and can be switched through remote control by means of the pressure coupled from the feed cylinder.

5. The hydraulic control device according to claim 1, wherein:

there is a drive piston in the feed cylinder hydraulic cylinder connected to the feed chamber piston that drives the feed chamber piston, a main slide valve controls the feeding and loading phases of the feed cylinder in that the feed cylinder hydraulic cylinder has a first end-position indicator which emits a first end-position signal impulse when the drive cylinder piston reaches the end phase of the feeding stroke in the feed cylinder hydraulic cylinder and a second end-position indicator which emits a second end-position signal impulse when the drive cylinder piston reaches the end phase of the loading stroke in the feed cylinder hydraulic cylinder, an operating control valve is provided that is switched by the end-position signal impulses of the hydraulic cylinder end-position indicators and that operates in a push-pull mode to pressure load and pressure relief the inlet chambers of inlet valve and outlet valve control cylinders in such a manner that the inlet valve closes when the outlet valve opens and the closing and opening movements of the inlet valve and outlet valve take place in a reverse sequence, an end-position indicator is provided which produces an output impulse when the inlet valve reaches its blocking position, and an end-position indicator associated with the inlet valve is provided that produces an output signal correlated to the widest open position of the inlet valve, and that the outlet signals of the end-position indicators control the changeover of the main slide valve so as to regulate the feeding and loading phases of the feed cylinder.

6. The hydraulic control device according to claim 1, wherein:

there is a drive piston in the feed cylinder hydraulic cylinder connected to the feed chamber piston that drives the feed chamber piston, a main slide valve controls the feeding and loading phases of the feed cylinder in that the feed cylinder hydraulic cylinder has a first end-position indicator which emits a first end-position signal impulse when the drive cylinder piston reaches the end phase of the feeding stroke in the feed cylinder hydraulic cylinder and a second end-position indicator which emits a second end-position signal impulse when the drive cylinder piston reaches the end phase of the loading stroke in the feed cylinder, an operating control valve is provided that is switched by the end-position signal impulses of the hydraulic cylinder end-position indicators that operates in a push-pull mode to pressure load and pressure relief the inlet chambers of the inlet valve and outlet valve control cylinders in such a manner that the inlet valve closes when the outlet valve opens and the closing and opening movements of the inlet valve and outlet valve take place in reverse sequence, an end-position indicator is provided which produces an output impulse when the inlet valve reaches its blocking position and an end-position indicator associated with the outlet valve is provided that produces an output signal when the outlet valve reaches its blocking position, and the signals of the end-position indicators control the changeover of the main slide valve so as to regulate the leading and loading phases of the feed cylinder.

7. The hydraulic control device according to claim 1, wherein:

the viscous fluid pump is designed as a two-cylinder pump, including two feed cylinders, each feed cylinder having a hydraulic cylinder associated therewith, the feed cylinders being driven in push-pull operation controlled by a changeover of a main slide valve, the feed chambers of the feed cylinders being connected through inlet valves to the storage container and through outlet valves to the feed line, the push-pull operation of the feed cylinders being communicated through the main slide valve by the push-pull control of the feed cylinder hydraulic cylinders by means of control cylinders for controlling the inlet and outlet valves associated with each feed cylinder with the operating control of the inlet valves taking place through the hydraulic differential control cylinders controlling the inlet valves through two control lines a first control line of which is under a high control-pressure level the second of which is connected to the pump drive, the first and second control lines being selectively connected to the feed cylinder inlet valves by means of an operating control valve, with the first control line being connected to the bottom-side control chamber of a first outlet valve control cylinder and being connected to the rod-side control chamber of a second outlet valve control cylinder and the second control line being connected to the bottom-side control chamber of the second outlet valve control chamber and also being connected to the rod-side control chamber of the first outlet valve control chamber, a changeover cylinder, characterized in that outlet signals needed for the reversal of the operating control valve are emitted by end-position impulse transmitters which are associated with one of the feed cylinder hydraulic cylinders provided for one of the feed cylinders, each end-position pulse transmitter emitting a signal when the piston of the associated hydraulic cylinder reaches its end position connected with the end phase of the feeding stroke or the end phase of the loading stroke, and that the control signals needed for the changeover control of the main slide valve are produced by end-position indicators which are associated with the inlet valve control cylinders, the inlet valve end-position indicators being configured to emit end-position impulses when the pistons of inlet valve control cylinders reach the end position connected with the closed positions of their respective valves.

8. The hydraulic control device according to claim 7 further including an operational changeover device for switching the pump to return operation, during which viscous fluid is pumped from the feed line back into the storage container, characterized in that the operational control device is configured to reverse the connections of the first and second control lines to the outlet valve control chambers.

9. The hydraulic control device according to claim 7, for a two-cylinder viscous fluid pump including:

a tube switch for the alternating coupling a first feed cylinder in a feeding operation to a feed line and opening of the other feed cylinder toward a storage container;

a third end-position signal indicator for producing outlet signals as soon as a changeover operation of the tube switch occurs;

a shutoff device for blocking off the feed line during a changeover operation of the tube switch;

a closing and opening drive for the feed line shutoff device, the drive including a differential cylinder, a piston rod in the differential cylinder for actuating the shutoff device, the piston rod being configured to reach a blocking position when a bottom-side drive chamber of the differential cylinder is loaded with pressure through the changeover control device and configured to reach an open position when the bottom-side drive chamber is relieved of pressure toward the tank source of pressurized fluid;

an end-position impulse transmitter for producing an impulse signal when the shutoff device has reached its blocking position; and operational changeover valves the base position of which are in through-flow positions associated with the normal feeding operation, and alternative positions associated with a return operation in which the pump pumps viscous fluid from the feed line back into the storage container, characterized in that within the sequence controller there is provided a valve combination including a closing valve and an opening control valve in a hydraulic series arrangement, the valve combination having a first outlet connected to a control inlet of the changeover control device through which the pressure loading of the shutoff device control chamber occurs for closing the shutoff device, the pressure relief of the shutoff device control chamber for opening the shutoff device also occurring and a second outlet is connected through a first operational changeover valve associated with a rod-side control chamber of the differential cylinder of the shutoff device with the pressure at the two outlets of the valve combination being reversed through individual changeover of the closing and opening control valves.

10. The hydraulic control device according to claim 9, characterized in that a second operational changeover valve is provided that is associated with the shutoff device the operating position of the second operational changeover valve being associated with the return operation of the pump the high control pressure is permanently present at the first operational changeover valve of the shutoff device.

11. The hydraulic control device according to claim 9, characterized in that the differential cylinder provided for the changeover of the shutoff device has an end-position indicator which, during the feeding operation of the viscous fluid pump produces outlet signals when the shutoff device reaches the closed position, the outlet signals controlling a supply control valve through which high pressure fluid is fed to the operating control valve for controlling the pressure supply of the changeover cylinders of the tube switch, and a changeover control valve is provided that is connected in parallel with the supply control valve the changeover control valve being designed as a 2/2-way valve, having a base position associated with the feeding operation of the viscous fluid pump and a blocking position associated with the return operation of the pump wherein, when the changeover control valve is in the return operation position, high pressure control fluid is fed to the operating control valve.

12. The hydraulic control device according to claim 7, characterized in that end-position impulse signals released with the closing of the feed cylinder inlet valves are applied to the main slide valve through time-delay elements.

13. The hydraulic control device according to claim 12, characterized in that the main slide valve is designed as a pressure-controlled valve, which is switched through an alternative pressure loading of two control chambers between two operating positions, in which each one of the drive cylinders of the pump is loaded with pressure and the other one is relieved of pressure, and the end-position that monitor the state of the inlet valves send end-position impulses to the main slide valve control chambers when the inlet valves reach their blocking positions to control the state of the main slide valve.

14. The hydraulic control device according to claim 13, characterized in that the impulse-signal paths for the end-position impulses to the control chambers of the main slide valve are guided through an operational changeover valve having a base position associated with the normal feeding operation, and an alternative position of which is associated with a return fluid flow operation of the pump.

15. The hydraulic control device according to claim 13, characterized in that the throttle points of the impulse-signal paths are formed by adjustable throttles.

* * * * *

UNITED STATES PATENT AND TRADEMARK OFFICE

CERTIFICATE OF CORRECTION

PATENT NO. : 5,520,521
DATED : May 28, 1996
INVENTOR(S) : Hartmut BENCKERT et al It is certified that error appears in the above-indentified patent and that said Letters Patent is hereby corrected as shown below:

Column 21, line 21; after "operable" insert ---pressure-relief---.
line 29; change "control" to ---pressure-relief---.
line 37; before "relief" insert --- pressure- ---; and delete "control".
line 44; before "relief" insert --- pressure- ---; and delete "control".
line 59; change "drive" to ---feed---.
line 63; change "drive" to ---feed---.
Column 24, line 51; before "that" insert ---indicators---.

Signed and Sealed this

Twenty-fifth Day of February, 1997

*Attest:*

*Attesting Officer*

BRUCE LEHMAN

*Commissioner of Patents and Trademarks*